US006736225B2

(12) United States Patent
Pierce

(10) Patent No.: US 6,736,225 B2
(45) Date of Patent: May 18, 2004

(54) GUIDE FOR ATTACHMENT TO A ROOF BOLTER TO ALLOW FOR CORE DRILLING

(75) Inventor: Paul A. Pierce, Spokane, WA (US)

(73) Assignee: The United States of America as represented by the Department of Health and Human Services, Washington, DC (US)

( * ) Notice: Subject to any disclaimer, the term of this patent is extended or adjusted under 35 U.S.C. 154(b) by 44 days.

(21) Appl. No.: 10/221,289

(22) PCT Filed: Mar. 14, 2001

(86) PCT No.: PCT/US01/08102

§ 371 (c)(1),
(2), (4) Date: Sep. 9, 2002

(87) PCT Pub. No.: WO01/71148

PCT Pub. Date: Sep. 27, 2001

(65) Prior Publication Data

US 2003/0205411 A1 Nov. 6, 2003

Related U.S. Application Data

(60) Provisional application No. 60/190,811, filed on Mar. 21, 2000.

(51) Int. Cl.[7] ..... E21B 25/00; E21B 19/24; E21B 7/02

(52) U.S. Cl. ..... 175/58; 175/220; 175/87; 175/162; 173/38; 173/184

(58) Field of Search ..... 175/58, 20, 220, 175/162, 203, 161, 87; 299/11; 405/288; 166/102; 173/38, 32, 34, 104, 20, 37

(56) References Cited

U.S. PATENT DOCUMENTS

| | | | | |
|---|---|---|---|---|
| 1,585,668 A | | 5/1926 | Hansen | |
| 1,614,123 A | | 1/1927 | Hansen | |
| 1,644,026 A | | 10/1927 | Mock | |
| 2,365,680 A | | 12/1944 | Curtis | |
| 2,365,683 A | | 12/1944 | Curtis et al. | |
| 3,334,948 A | * | 8/1967 | Qvarnstrom | 384/24 |
| 3,441,323 A | | 4/1969 | Vincent et al. | |
| 3,967,686 A | | 7/1976 | Fogelstrom | |
| 4,076,337 A | * | 2/1978 | Childress | 384/24 |
| 4,105,081 A | | 8/1978 | Perraud | |
| 4,108,253 A | * | 8/1978 | Woodford, II | 173/189 |
| 4,158,520 A | | 6/1979 | Prebensen | |
| 4,311,347 A | * | 1/1982 | Cobb | 384/24 |
| 4,326,756 A | * | 4/1982 | Moroz et al. | 384/24 |
| 4,398,850 A | | 8/1983 | Talvensaari | |
| 4,420,277 A | | 12/1983 | Hibbard et al. | |
| 4,702,328 A | | 10/1987 | McSweeney et al. | |
| 4,740,037 A | | 4/1988 | Eager et al. | |
| 4,759,888 A | | 7/1988 | Brest van Kempen | |
| 5,556,235 A | * | 9/1996 | Morrison et al. | 405/303 |
| 6,263,985 B1 | * | 7/2001 | Scheid et al. | 175/162 |
| 6,302,410 B1 | * | 10/2001 | Wentworth et al. | 279/152 |

FOREIGN PATENT DOCUMENTS

| | | |
|---|---|---|
| GB | 2071736 | 9/1981 |
| GB | 2302890 | 2/1997 |

* cited by examiner

*Primary Examiner*—David Bagnell
*Assistant Examiner*—Shane Bomar
(74) *Attorney, Agent, or Firm*—Klarquist Sparkman LLP

(57) ABSTRACT

The present disclosure provides a coring guide for converting a mine roof bolter into apparatus suitable for guiding a coring rod, or drill, into a mine roof, as well as a method for obtaining a geological core from the mine roof using the guide. The guide includes a pair of jaws, wherein each jaw has an adapter end and a pivotable end. The adapter end of each jaw includes a cavity that faces a cavity included in the adapter end of the other jaw, such that the closed jaws form at least a major portion of a cylindrical coring cavity that accommodates a coring rod. Each jaw includes means for fixing the rod guide within a mine roof bolter apparatus such that when the coring guide is positioned between the jaws and the jaws are partially closed such that they enclose the coring rod, the roof bolter causes the coring rod to penetrate the mine roof and obtain a core sample. The method of obtaining the geological core includes installing the rod guide into the roof bolter apparatus, introducing a cylindrical coring rod, driving the coring rod into the mine roof sufficiently to accumulate a core therein, and withdrawing the rod.

21 Claims, 4 Drawing Sheets

A
86
52a
50
72a
72b
54a
52
R
60a
62
66
62
76
86
60b
90
68
60
52b
60
80
54b
54

GUIDE FOR ATTACHMENT TO A ROOF BOLTER TO ALLOW FOR CORE DRILLING

This application priority of appln 60/190,811 filed Mar. 21, 2000.

FIELD OF THE INVENTION

This disclosure relates to a novel adapter (i.e., guide or chuck) for use in a mine roof bolting apparatus that permits conversion of the roof bolter into core drilling apparatus. The disclosure also relates to a method of converting the bolting apparatus and obtaining a core sample.

BACKGROUND

Underground mining machinery includes specialized apparatus adapted to carry out the operations required for obtaining the desired materials from the earth while maintaining mine integrity and safety. These include longwall mining systems, continuous mining machines, loader machines, face-haulage vehicles, roof or rock, bolters, and comparable mining vehicles and equipment.

Currently there are about 2,000 underground mines operating in the United States, including about 1,200 to 1,400 coal mines, about 500 to 600 mineral mines, and about 100 stone mines. In all underground mines, roof bolting is an operation that is essential in maintaining the integrity of a horizontal mine, helping to keep the roof of the mine from collapsing after material has been excavated from the mine face. The safety of the miners working in the mine environment thereby is enhanced. After material has been removed from the face of the mine, bolts are inserted and set into the roof of the mine to keep the roof from collapsing onto the workers. In order to improve safety, some mining machines have integrated the roof bolting apparatus into continuous mining machines, thereby reducing the risk of roof collapse. Since roof bolting is one of the most dangerous operations in underground mining, roof bolters that work ahead of the continuous mining machines are being developed. These pre-mining bolters drill into the seam to be mined and insert bolts at this early stage, thereby greatly reducing the risk of roof collapse. These newer roof bolter units may incorporate contemporary robotics technology.

U.S. Pat. No. 4,158,520 discloses a rock bolting apparatus in which a rock drill and a rock bolt setting device are interchangeable on a single elongated guide of a feed beam. When the rock drill is in operative position on the feed beam, the bolt setting device hangs on the side of the feed beam, and vice versa.

U.S. Pat. No. 4,420,277 discloses a mobile integrated apparatus for bolting the roof of an underground mine. The apparatus includes a mobile frame, a boom extending from the frame, and a housing provided at the end of the frame. The housing supports a drilling mechanism including a drill centralizer having a central bore therethrough and a passageway in communication with the central bore, a device for delivering a container of roof bolting anchoring media through the passageway, through the drill centralizer, and into a drilled hole, a device for indexing a roof bolt into alignment with the drilled hole and a spinner for driving the roof bolt into the drilled hole.

U.S. Pat. No. 4,759,888 discloses a means and method related to automatically installing full length grouted bolts as well as tensioned grouted bolts, which ensures proper shredding of the grout package, and proper mixing and curing of the grout. The inventive means further allows control of the depth of holes drilled for rock bolting and automatic freeing of drill steels.

U.S. Pat. No. 4,740,037 discloses a continuous mining machine including several components involved in cutting and conveying mined material, as well as a roof bolter. As a subframe is moved away from a main frame, the bolter is operated simultaneously with cutting to perform roof bolting operations close to the face of the mine.

U.S. Pat. No. 4,702,328 discloses a mine roof-drilling system including a lower surface of a retainer fixed to the drill head with an aperture formed therein to define a bearing surface for utilizing the drill head itself to pull the assemblage of drill steel from a completed bore.

U.S. Pat. No. 4,398,850 discloses a roof bolter and process for resin bolting a mine roof. Using two positions, the bolter drills and inserts resin in one position, and inserts a bolt in a second position. The invention also includes a device designed for attachment to a three-position resin type roof bolter to convert it into a two-position resin type roof bolter.

Much information relating to the strength and stability, or conversely, the weakness and instability, of strata that may overlay a newly-created mine roof, may be gleaned by an examination of the stratified geological structures present above the mine roof. For example, examination of such stratification could provide information to guide mine operators relating to the number of roof bolts required for a particular mine roof, as well as the lengths of roof or rocks bolts that may be required. Currently, such information is not obtained during the roof bolting and development stages.

There is therefore a need for providing a means of readily obtaining core samples from the roof of an advancing mine. There is furthermore a need for minimizing the number of pieces of equipment needed to carry out such coring operations, since the space available in advancing mine development areas is severely limited. Provision of a modular apparatus that could be used for both roof bolting and roof coring operations would be greatly advantageous. The present disclosure recognizes these needs.

SUMMARY OF THE DISCLOSURE

The present disclosure provides a guide, or adapter, for converting a mine roof bolter into an apparatus suitable for guiding a coring rod, or drill, into a mine roof and obtaining a core sample. Information from such core samples can be used to evaluate the roof structure and more accurately determine mine bolt placement.

The guide may include a pair of jaws, each jaw having an adapter end and a pivotable end, with the pivotable end of each jaw being pivotally coupled to the pivotable end of the other jaw, means yieldably biasing the jaws to an open position with respect to each other, and the adapter end of each jaw includes a jaw cavity that faces the jaw cavity included in the adapter end of the other jaw, with each jaw cavity having a cross section that forms an arc of a circle with a central axis, wherein when the jaws are closed to a maximal extent, the jaw cavities form between them at least a major portion of a cylindrical coring cavity in which the central axes of the jaw cavities are disposed substantially on a common cylinder axis, the coring cavity having a cavity cylinder diameter substantially equal to the coring diameter, and adapted to enclose or grasp a coring rod, or drill, therein. In one embodiment, each jaw includes means for holding the rod guide within the mine roof bolter such that, when the coring rod is positioned between the jaws and the jaws are closed such that they enclose or grasp the rod, the roof bolter may engage the coring rod causing it to penetrate the mine roof and obtain a core sample, thereby converting the mine roof bolter into a mine roof coring apparatus.

In a preferred embodiment of the rod guide, the means to bias the jaws to an open position with respect to each other includes at least one spring element having two ends, with one end coupled to one of the jaws and the other end coupled to the other jaw, and operable to yieldably bias the jaws toward maintaining the jaws in a position opened to an extent sufficient to permit a coring rod to be placed between the jaws.

In an additional preferred embodiment, means for fixing the rod guide within the mine roof bolter may be one or more tabs or projections that match a receiving recess in the mine roof bolter.

In another aspect, a method of obtaining a core sample from a mine roof is disclosed. The method includes the steps of providing a coring rod guide adapter having a pair of opposed jaws having jaw cavities therein which together define a cylindrical coring cavity having a diameter substantially equal to a coring diameter, and placing the rod guide within a pair of guide members, inserting a coring rod into the coring rod guide such that the rod guide grasps or encloses the coring rod, engaging the coring rod with means for impelling the coring rod into the mine roof, causing the roof bolting apparatus to impel the coring rod into the mine roof, and withdrawing the coring rod with a core sample contained therein from the mine roof thereby obtaining a core sample.

The present disclousre is mainly directed to obtaining core samples from mine roofs in order to obtain information and data regarding the structure of the overlying strata and to determine bolting strategies to provide a safe work environment. Of course, as those skilled in the art will realize, the rod guides and methods of this disclosure can also be used in other drilling and core sampling applications such as, for example, rib or mine wall drilling, long hole drilling, and the like. In these applications, the rod guide would be used in the same manner as for roof bolting except that the drilling angle of the rock or roof bolter would be modified as appropriate. For purposes of this disclosure, reference to mine roofs, roof bolting, roof coring, and the like is intended to also include these alternative drilling/coring and applications.

DETAILED DESCRIPTION OF A PREFERRED EMBODIMENT

Figure 1:
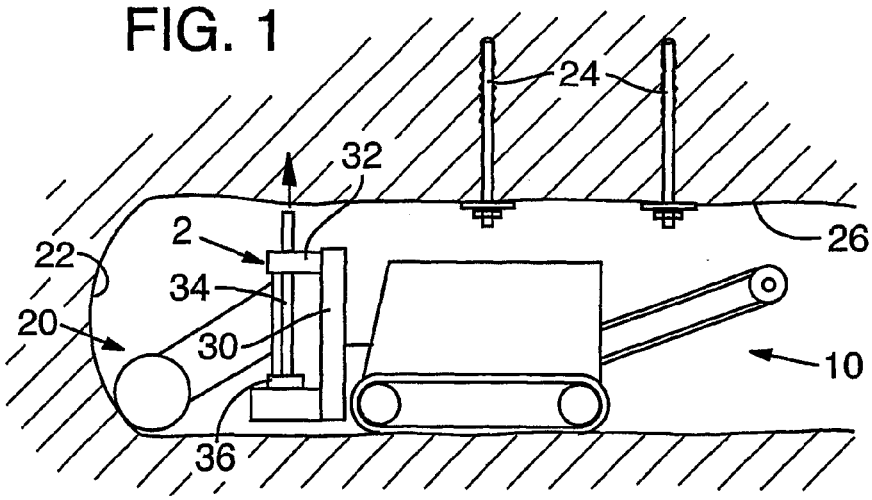
FIG. 1 is a sectional view of a mine illustrating schematically a machine used for drilling and inserting roof bolts.

Referring to FIG. 1, a typical roof drilling machine is depicted generally at 10. The machine is illustrated operating in a mine 20 near the mine face 22. The machine is operable to drill holes into the roof of the mine and insert roof bolts, or rock bolts, as indicated generally at 24 to stabilize, or secure, the roof 26 of the mine.

Machine 10 has a forwardly mounted mast 30 on which is mounted an upper pair of guide members, or jaws, 32 to hold and guide an elongate rock drill shaft indicated generally at 34. At the lower end of mast 30 is a driving mechanism 36 to which the lower end of rock drill 34 is coupled to produce rotational driving of the rock drill. The rock drill is driven upwardly and rotated to drill a hole into roof 26 into which a roof bolt 24 then may be inserted. The roof bolts also are gripped and guided by guide members 32 for driving into the roof as illustrated for previously installed bolts 24.

Figure 2:
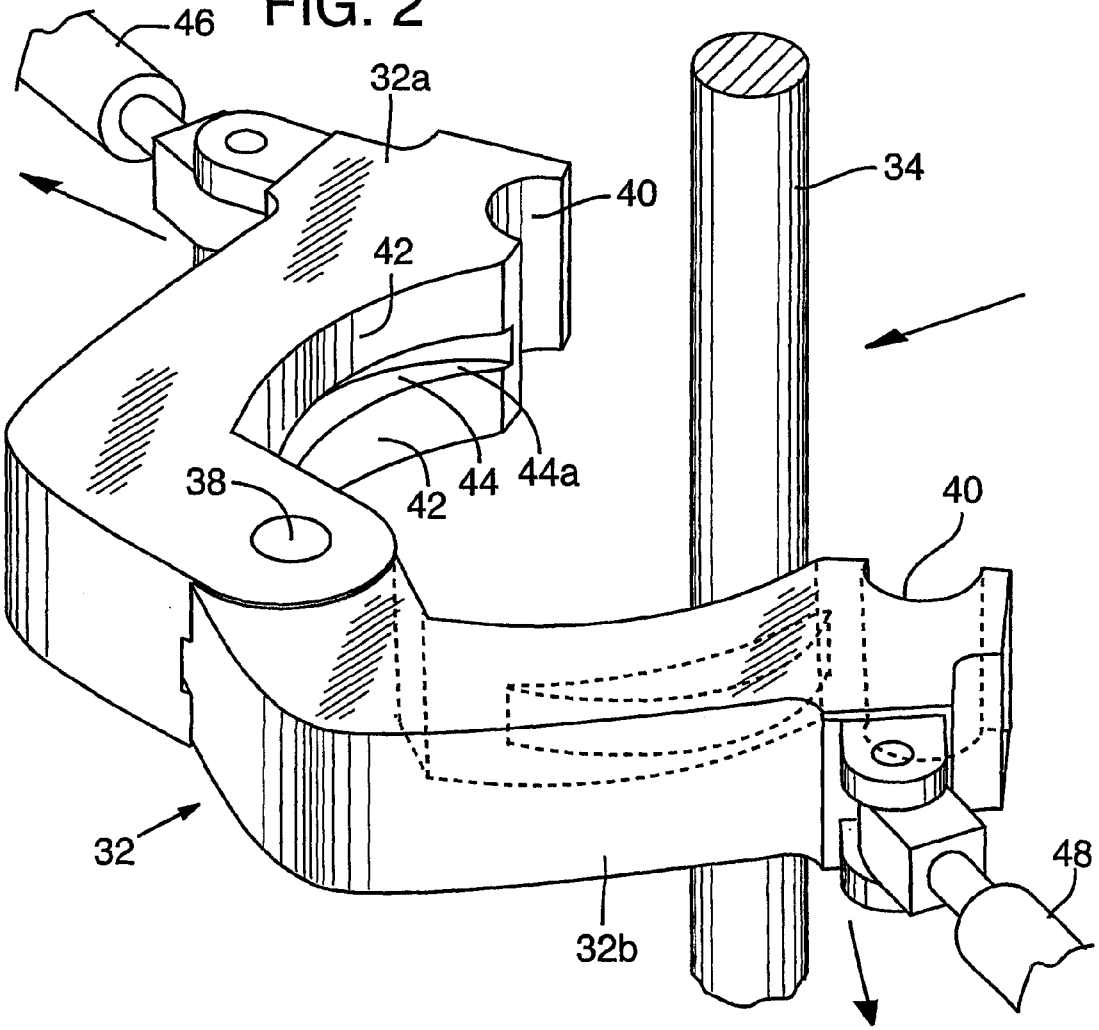
FIG. 2 is an enlarged perspective view taken generally in the region noted 2 in FIG. 1, of a pair of guide members which might be used in the machine, illustrating the guide members opened to receive a rock drill or roof bolt therebetween.

FIG. 2 illustrates a larger perspective view of examples of guide members 32 such as may be used on the roof bolter, which are operable to receive and guide rock drill 34 and roof bolts 24. A rod section of a rock drill 34 is illustrated generally in FIG. 2. Such would have a diameter of approximately one inch (2.54 cm).

The guide members shown here as 32*a*, 32*b* in FIG. 2 are substantially mirror images of each other. Thus the general structure of one will be described, with the understanding that such structure is similar for the other. Also it should be recognized that the structure of the guide members described here is merely exemplary of guide members which may be used in a machine such as that noted at 10. Other forms of guide members with which the core drilling adapter may be used may differ in overall configuration from those illustrated at 32*a*, 32*b*.

Referring to guide member 32*a*, it is a rather substantial formed member having a vertically disposed semi-cylindrical guide cavity 40 formed therein adjacent the outer end of member 32*a*. Progressing rearwardly (toward the viewer in FIG. 2) the inner surface 42 has a somewhat arcuate concave sweeping configuration which has a horizontally disposed arcuate recess 44 formed therein with a lower ledge 44*a*.

Guide members 32*a*, 32*b* are mounted for shifting toward and away from each other under the influence of powered operating mechanism. In the illustrated embodiment the guide members are pivotally interconnected by a pivot pin 38. The operating mechanism may be in the form of hydraulic rams such as those indicated at 46, 48 connected to guide members 32*a*, 32*b*, respectively. Retraction of rams 46, 48 swings guide members 32*a*, 32*b* away from each other to the position illustrated in FIG. 2 to receive a rock drill or roof bolt within cavities 40. As the rams are extended, the guide members 32*a*, 32*b* are moved toward each other whereby their cavities 40 encircle the rock drill or roof bolt. For rotational driving of a rod, the guide members 32*a*, 32*b* are not closed tightly about the rod, but instead are held loosely thereabout to provide a substantially cylindrical guide which allows the rod to rotate therein under the actuation of drive mechanism 36 to which the bottom end of the rod is coupled.

Should it be desired to firmly grip, or grasp, a rod, such as for pulling it from a hole or for driving it into a hole, rams 46, 48 are extended further to clamp the guide members 32*a*, 32*b* tightly against the rod so that it is firmly and frictionally held therein.

As previously discussed, it may be advantageous to take coring samples of the material strata in the roof of the mine to determine optimal roof bolting conditions. The present disclosure provides an adapter for converting the mine roof bolter as described into apparatus adapted for operating a coring rod, or drill, to obtain core samples using the same primary machine indicated generally at 10. In this way, the same machine and operator may perform the combined tasks of drilling, setting roof bolts, and taking core samples.

Figure 3:
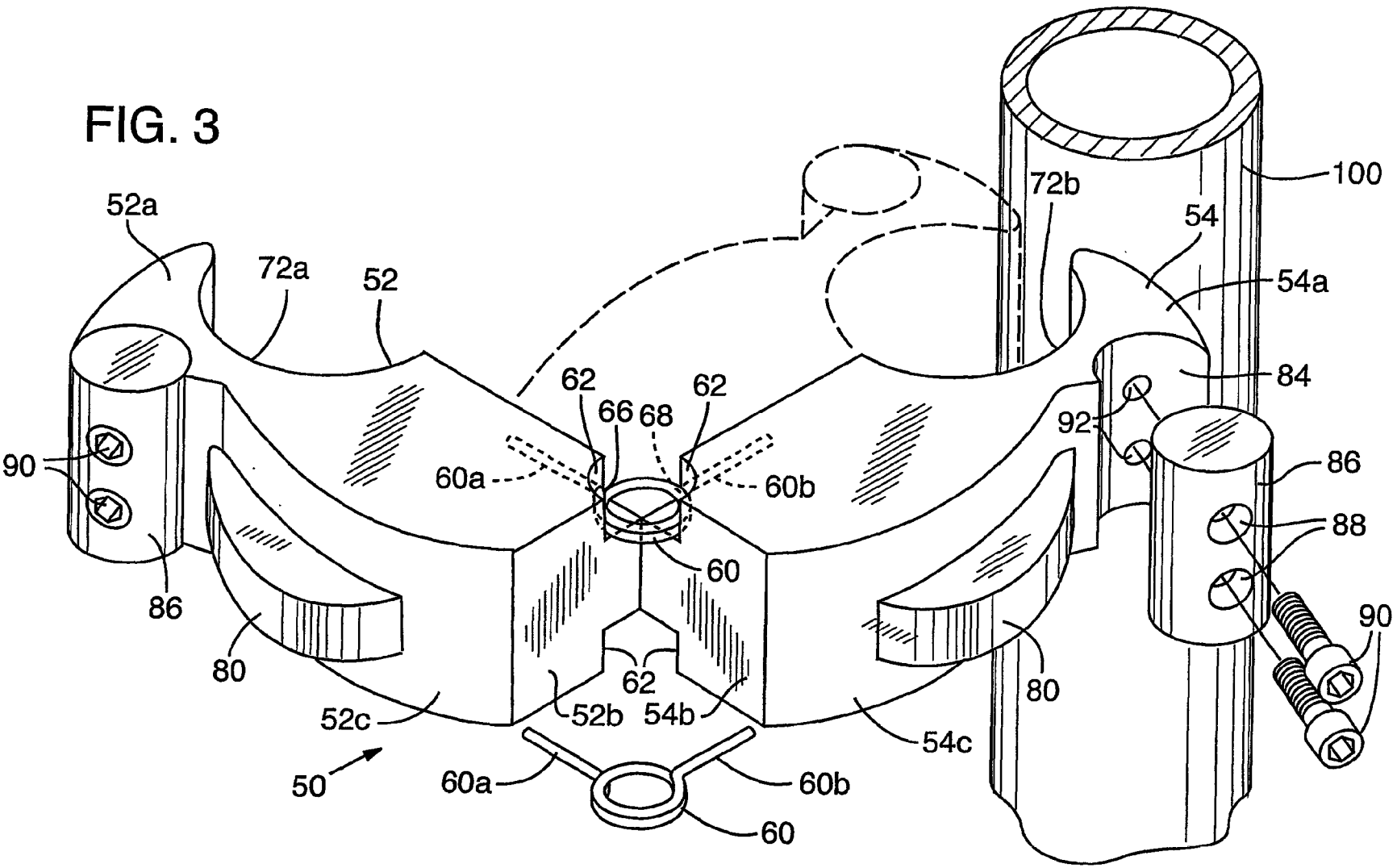
FIG. 3 is a perspective view of a coring rod guide assembly according to an embodiment of the present disclosure with the jaws thereof opened.
Figure 4:
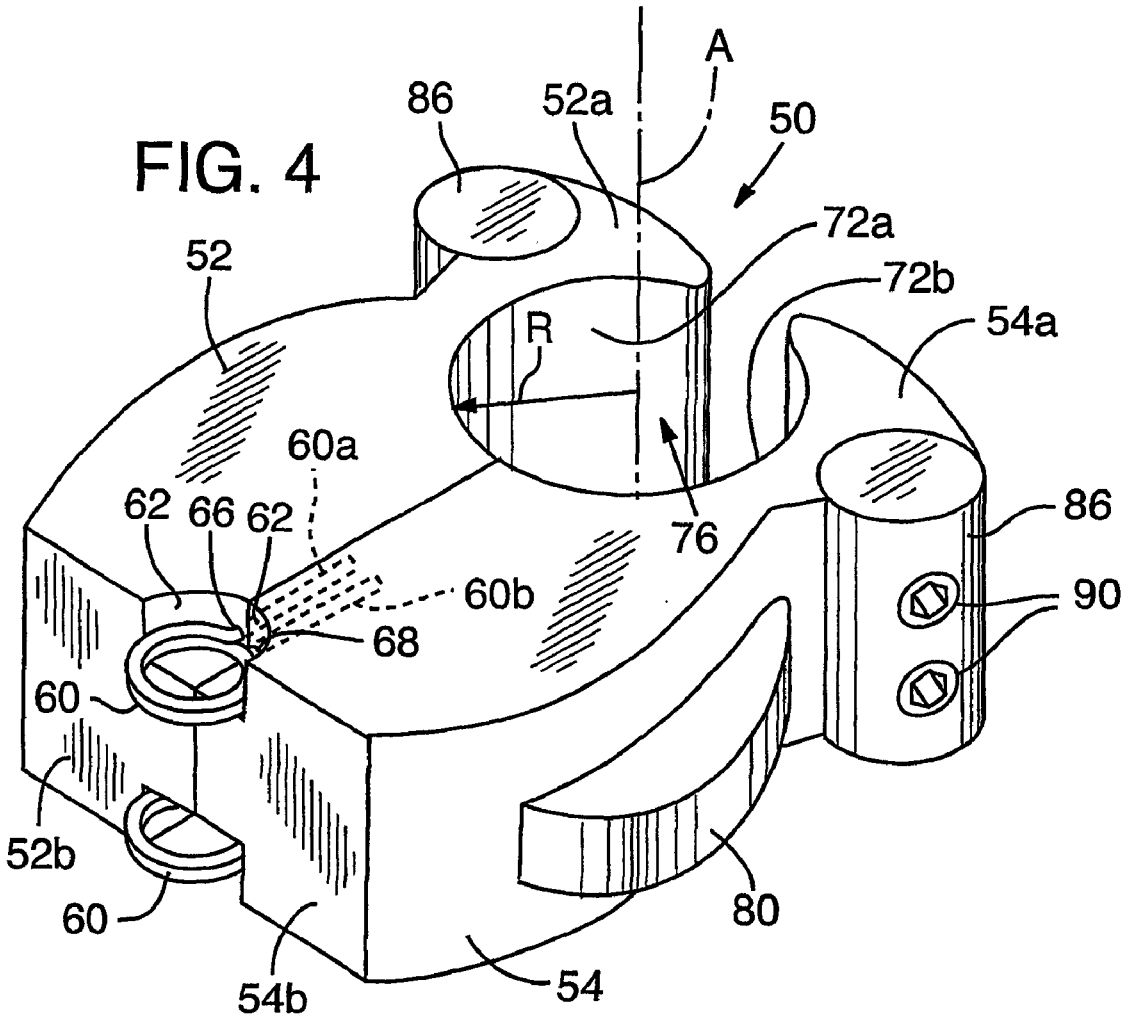
FIG. 4 shows the coring rod guide assembly of FIG. 3 with the jaws closed.

A core drill adapter, or coring rod guide for converting a mine roof bolter into apparatus adapted for guiding a coring rod (also referred to as a coring barrel assembly) into a mine roof is shown generally in FIGS. 3 and 4 at 50. The coring rod guide includes two jaws 52, 54 which are essentially mirror images of each other. Each jaw has an outer end 52*a*, 54*a* and an inner end 52*b*, 54*b* adjacent which the two jaws are pivotably coupled to one another.

There are furthermore means provided in the assembly for yieldably biasing the jaws toward a position that is opened, that is in which the outer ends of the jaws are separated from one another by a large gap as in FIG. 3. In the embodiment shown, the biasing means are coil springs 60 resting in recesses 62 provided in each jaw. In FIG. 3 one spring is shown attached to jaws 52, 54 and the other is illustrated ready for attachment. Each coil spring has two elongate ends 60*a*, 60*b*, one of which is inserted into a receiving hole 66 bored into one jaw, and the second of which is inserted into a corresponding receiving hole 68 of the other jaw. The resting position of the two spring ends is sufficiently open that, when the spring arms are inserted into the receiving holes in the jaws, and the jaws are moved toward each other from the positions illustrated in FIG. 3, the jaws are yieldably biased toward opening to a considerable extent.

The outer, or adapter, end portion of each jaw 52*a*, 54*a* includes structure that defines a concave jaw cavity, or void region, 72*a*, 72*b* intended to receive a coring rod which has a larger diameter than the previously described rock drill or roof bolt shaft. The cavity in each jaw has a cross section that forms an arc of a circle. The cavity 72*a* in one jaw faces the corresponding mirror image cavity 72*b* included in the adapter end of the other jaw. The centers of each circle of arc substantially coincide in the mirror plane between the jaws such that, when the jaws are closed to a maximal extent, the coring rod receiving, or coring, cavity 76 formed between the adapter ends of the closed jaws forms at least a major portion of a cylindrical cavity 76 with a common cylinder axis "A." The cavity has a cavity cylinder radius "R." Since the cylinder axis identified using the circle of arc of one jaw coincides with the axis defined using the second jaw, the entire cavity present when the jaws are closed is defined by a surface made by the two jaws that is at least a major portion of a single cylinder.

Suitable materials of construction for the guide are standard carbon steels or alloy steels which are readily machinable. Composite materials also may be used if highly resistant to impact and wear. Advanced composite fabrics in a laminate can also be used if desired.

The outer sides 52*c*, 54*c* of jaws 52, 54 have arcuate configurations conforming generally to portions of the arcuate configurations of inner surfaces 42 of the guide members. Further, protruding tabs, ridges, or projections, 80 extending horizontally and outwardly from surfaces 52*c*, 54*c* are positioned and configured to be received in recesses 44 in guide members 32*a*, 32*b*. When tabs 80 are received in recesses 44 the undersides of the tabs are supported on ledges 44*a* in the recesses.

The outer ends of sides 52*c*, 54*c* have arcuate recesses indicated generally at 84 adapted to receive cylindrical rod-shaped tabs, or projections, 86. A pair of holes 88 extend through each rod-shaped tab 86 through which a pair of screws 90 extend to be received in threaded bores 92 in recesses 84. Rod shaped tabs 86 have a radius similar to the radius of guide cavities 40 in guide members 32*a*, 32*b* and are positioned such that jaws 52, 54 may rest within guide members 32*a*, 32*b* with tabs 80 received in recesses 44 and tabs 86 received in cavities 40. These tabs serve as means for fixing, or holding, the coring drill rod guide within a mine roof bolter apparatus. Although the tabs, recesses, and cavities shown serve this function very well, it should be understood that other means for releasably fixing or holding the adapter in the guide members of the drilling apparatus also could be used.

To affix the coring rod guide to the roof bolter apparatus, guide members 32*a*, 32*b* are swung apart by retraction of rams 46, 48. Jaws 52, 54 are swung toward each other to assume a position similar to that illustrated in FIG. 4 and inserted into the position between guide members 32*a*, 32*b*. When tabs 80 on opposite side of the coring drill guide are aligned with recesses 44 in the guide members and tabs, or projections, 86 are aligned generally with cavities 40 the force holding the jaws together against the yieldable biasing of springs 60 is released and the jaws are allowed to be swung apart under the action of springs 60 with tabs 80 entering recesses 44 and tabs, or projections, 86 entering cavities 40. The coring rod guide thus will be held within guide members 32*a*, 32*b*. This is shown in FIG. 5.

Figure 5:
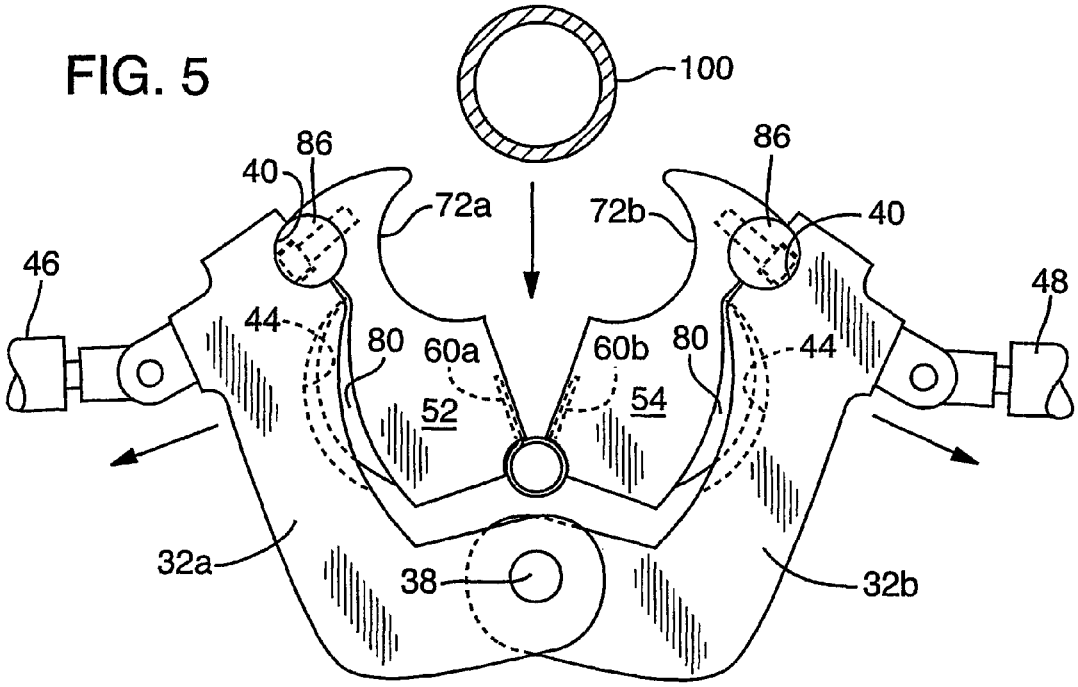
FIG. 5 is a top plan view of the coring rod guide received in the guide members of the bolting machine with the jaws spread to receive a coring rod.
Figure 6:
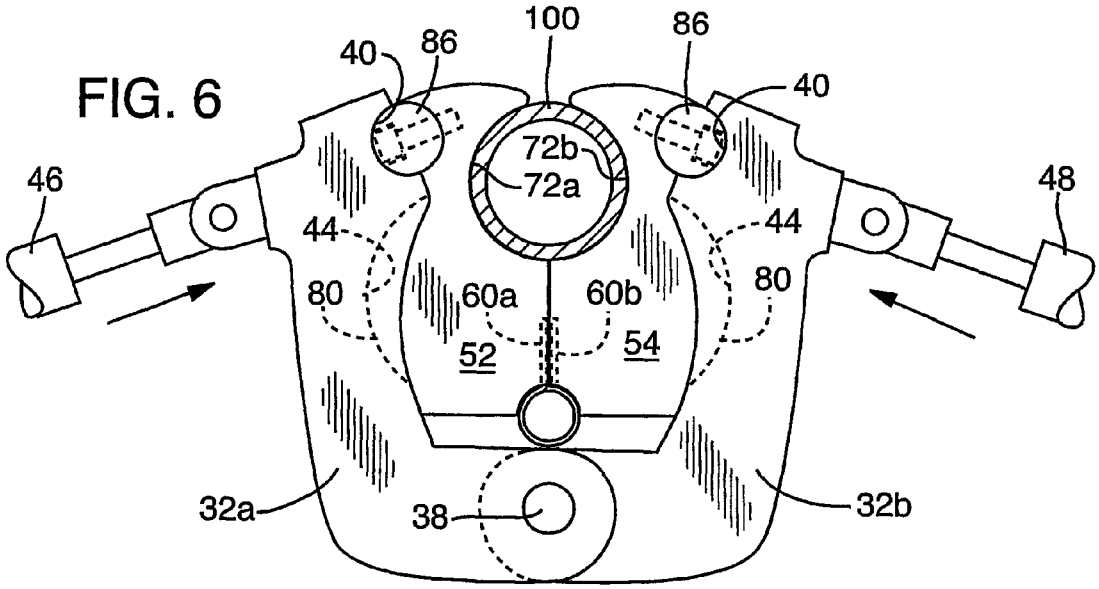
FIG. 6 is a top plan view similar to FIG. 5 with the jaws closed about a coring rod.

With guide members 32*a*, 32*b* spread widely enough apart to allow jaws 52, 54 to be spread apart as shown in FIG. 5, a hollow cylindrical coring rod, or coring barrel assembly, 100 may be inserted into the space between jaw cavities 72*a*, 72*b*. Extension of rams 46, 48 swings guide members 32*a*, 32*b* and jaw members 52, 54 toward each other to the position illustrated in FIG. 6 with the coring rod held between the two half-cylindrical jaw cavities 72*a*, 72*b* formed by each of the jaws. When the jaws are partially closed and the coring rod is held within the cylindrical cavity 76 formed between the jaws, the jaws enclose the coring rod, such that the coring rod may rotate within cavity 76. In this operation rams 46, 48 are not extended to clamp the jaws tightly against the coring rod. Instead, they leave the jaws of the coring rod guide somewhat loose on the coring rod to allow it to rotate therein. When the rams 46, 48 are extended further, they clamp tightly about the coring rod 100 to grasp it frictionally and tightly therein.

The geometry of the coring rod guide is such that when a coring rod 100 is held within the grasp of the guide its centerline is close to the centerline that a drill rod such as 34 in FIG. 2 would occupy when the guide members 32*a*, 32*b* are closed on the smaller diameter rod. Thus the lower end of coring rod 100 rests adjacent and in operative position over driving mechanism 36 and may be coupled thereto for driving. When the coring rod is coupled to the driving mechanism and loosely held in the jaws, it may be rotated and driven upwardly to drill into the overlying strata.

The coring rod has a cylindrical rod radius which is essentially the same as the cavity cylinder radius R. In general the coring rod radius, and therefore the cavity radius R, may be from about 1.25 to about 2 inches or 3.175 to 5.1 cm (a diameter of 2.5 to 4 inches or 6.35 to 10.15 cm) and preferably from about 1.25 to about 1.5 inches or 3.175 to 3.8 cm (a diameter of about 2.5 to 3 inches or 6.35 to 7.6 cm). In addition, the height of each jaw, in the direction of the cylinder axis, may be from about 1 to about 4 inches or 2.54 to 10.15 cm, and preferably from about 2 to about 3 inches or 5.1 to 7.6 cm. It should be understood, however, that dimensions larger or smaller than these may be used and in some cases may be appropriate.

In operation, a roof bolter apparatus is fitted with a modular chuck or guide suitable for guiding a drilling steel and/or a bolt into a region of the mine roof. This modular chuck or guide is not required to be removed from the bolter apparatus in order to allow affixing the coring rod guide. The coring rod guide, or adapter, 50 is compressed and fitted in the modular drilling or bolting chuck 32. For example, the tabs 80, 86 on the jaws that match receiving recesses in the guide members 32*a*, 32*b* are employed to orient and fix the coring rod guide to the roof bolting apparatus. Since the rod-shaped tabs 86 are replaceable due to screw connectors 90, they may be replaced with tabs of different configuration if needed. Tabs 80 also might be made replaceable. Of course, the coring rod guide, or adapter, 50 can be designed to replace the modular chuck or guide.

Once in place, the jaws 52, 54 of the coring rod guide are permitted to flex to an open position under the influence of the open-biasing means, such as the coil springs 60, emplaced between and joining the two jaws to each other. Suitable means or mechanisms resident in the roof bolting apparatus are concurrently opened or relaxed, such that the jaws of the coring rod guide open to a considerable extent.

In this opened configuration, as shown in FIG. 5, a hollow coring rod, or coring barrel assembly, 100 is positioned in the cavity space between the opened jaws. At this time, or at a time after the jaws enclose the coring rod, the coring rod is coupled to the driving mechanism 36 which, when operated, drives the coring rod into the mine roof. The jaws are moved to a closed position, using force generated by the roof bolting apparatus countering the opening bias provided, for example, by the spring coils 60, thereby forming the cylindrical cavity 76 between the jaws 52, 54 at their adapter ends 52*a*, 54*a*. Since the cylindrical radius of the cavity and the cylindrical radius of the coring rod are essentially identical, the coring rod is either surrounded loosely by or grasped tightly within the cavity depending on the extent to which the jaws 52, 54 are closed.

With the coring rod loosely held and guided by jaws 52, 54, the driving mechanism coupled to the coring rod may be activated. The mechanism causes the coring rod to turn on its axis as well as to advance into the mine roof. As the coring rod advances into the strata above the roof, and since it is hollow, a core accumulates within the coring rod that reflects the stratification of the geological layers that reside above the mine roof The orientation of the strata in the earth is maintained within the coring rod. This differs significantly from prior art mine roof bolting apparatus, in which earth displaced from holes being drilled for bolting is removed and deposited in a remote area with no regard for maintaining its original stratification.

After the coring rod has advanced a suitable distance, such as a distance from about 2 feet, up to about 5 feet or 6 feet, for example, the coring rod is withdrawn, using a pulling or retracting force applied by the driving mechanism. To do this the jaws 52, 54 are clamped against the coring rod to tightly and frictionally hold it in the jaws. In this way the coring rod with the stratified core within is freed from the mine roof. At this juncture the core is extracted, examined, and analyzed in order to obtain comprehensive information related to the geological stratification above the mine roof. This information provides significant assistance in planning and implementing subsequent roof bolting operations in the vicinity of the core. Such cores are obtained as often as needed as the mine advances into the earth.

The coring rod guide provides an adapter unit which may be quickly and easily attached to a roof bolting machine to convert the roof bolter from its normal roof bolt drilling and setting procedure using a smaller diameter rod and bolts, to permit the taking of core samples with a larger diameter hollow cylindrical coring rod. In such operation, the same roof bolting machine may be used in the same general location in which it is already operating for producing roof bolting. Minimal time is required for converting from a roof bolting to a core drilling operation whereby it is convenient for operators to obtain information necessary to provide effective roof bolting.

While a preferred embodiment has been set out herein, it should be apparent to those skilled in the art that variations and modifications are possible without departing from the spirit of the invention.

I claim:

1. A guide for converting a mine roof bolter having a pair of guide members mounted for shifting toward and away from each other to receive and guide a drill rod or bolt of a selected diameter into a mine roof coring apparatus suitable for receiving and guiding a coring rod having a coring diameter greater than said selected diameter, said guide comprising a pair of jaws, each jaw having an adapter end and a pivot end, with the pivot end of each jaw being pivotally coupled to the pivot end of the other jaw, means coupled to the jaws operable to yieldably bias the jaws to an open position with respect to each other, the adapter end of each jaw includes a jaw cavity that faces the jaw cavity included in the adapter end of the other jaw with each jaw cavity having a cross section that forms an arc of a circle with a central axis, wherein when the jaws are closed to a maximal extent, the jaw cavities form between them at least a major portion of a cylindrical coring cavity in which the central axes of the jaw cavities are disposed substantially on a common cylinder axis, the coring cavity having a cavity cylinder diameter substantially equal to said coring diameter, the pair of jaws being pivotable to an open position in which a cylindrical coring rod may be disposed between the jaws at their adapter ends, the jaws being pivotable to a closed position such that a cylindrical coring rod placed within the coring cavity is enclosed or grasped, and each jaw includes means for holding the guide within the mine roof bolter such that when the coring rod is positioned between the jaws and the jaws are closed such that they enclose or grasp the rod, the roof bolter may engage the coring rod causing it to penetrate the mine roof and obtain a core sample, thereby converting the mine roof bolter into a mine roof coring apparatus.

2. The guide of claim 1, wherein said means to bias the jaws to an open position comprises at least one spring element having two ends, with one end coupled to one of said jaws and the other end is coupled to the other of said jaws.

3. The guide of claim 2, wherein the said spring element comprises a coil spring having two ends, wherein one end rests within a spring end receptacle encompassed within one jaw and the other spring end rests within a spring end receptacle encompassed within the other jaw, and the spring element is biased toward maintaining the jaws in an open position.

4. The guide of claim 1, wherein the means for holding the rod guide within the mine roof bolter comprises a tab on a jaw configured to be received in a recess in a guide member of the mine roof bolter.

5. The rod guide of claim 4, wherein said tab and recess extend substantially horizontal.

6. The guide of claim 1, wherein a roof bolter guide member has a recess formed therein for receiving a drill rod or bolt and said means for holding the rod guide within the mine roof bolter comprises a projection configured to be received in said recess.

7. The guide of claim 6, wherein said projection comprises a projection member removably coupled to one of said jaws.

8. The guide of claim 7, wherein said projection member is replaceable to permit adapting said rod guide to operate with guide members of differing configurations.

9. The guide of claim 1, wherein a roof bolter guide member has a first horizontally disposed recess formed therein and a second vertically disposed recess formed therein for receiving a drill rod or bolt and said means for holding the rod guide within the mine roof bolter comprises a tab on a jaw configured to be received in said first recess and a projection configured to be received in said second recess.

10. The rod guide of claim 1, wherein the mine roof bolter includes mechanism for shifting said guide members toward each other under power and said jaw cavities are so configured that when forced toward each other toward a tightly closed position they may firmly and frictionally grip the coring rod therebetween.

11. The rod guide of claim 10, wherein the operating mechanism is actuatable to permit movement of said jaws away from said tightly closed position whereby the jaw cavities loosely enclose portions of the coring rod allowing guided rotation of the coring drill between said jaws.

12. A guide for converting a mine roof bolter having a pair of guide members mounted for shifting toward and away from each other to receive and guide a drill rod or bolt of a selected diameter into a mine roof coring apparatus suitable for receiving and guiding a coring rod having a coring diameter greater than said selected diameter, said guide comprising a pair of jaws, each jaw having an adapter end and a pivot end, with the pivot end of each jaw being pivotally coupled to the pivot end of the other jaw, means coupled to the jaws operable to yieldably bias the jaws to an open position with respect to each other comprising at least one spring element having two ends, with one end coupled to one of said jaws and the other end is coupled to the other of said jaws, the adapter end of each jaw includes a jaw cavity that faces the jaw cavity included in the adapter end of the other jaw with each jaw cavity having a cross section that forms an arc of a circle with a central axis, wherein when the jaws are closed to a maximal extent, the jaw cavities form between them at least a major portion of a cylindrical coring cavity in which the central axes of the jaw cavities are disposed substantially on a common cylinder axis, the coring cavity having a cavity cylinder diameter substantially equal to said coring diameter, the pair of jaws being pivotable to an open position in which a cylindrical coring rod may be disposed between the jaws at their adapter ends, the jaws being pivotable to a closed position such that a cylindrical coring rod placed within the coring cavity is enclosed or grasped, and each jaw being associated with a guide member, and a jaw and its associated guide member include complementary recesses and projections which interact for holding the guide within the mine roof bolter such that when the coring rod is positioned between the jaws and the jaws are closed such that they enclose or grasp the rod, the roof bolter may engage the coring rod causing it to penetrate the mine roof and obtain a core sample.

13. The guide of claim 12, wherein the said spring element comprises a coil spring having two ends, wherein one end rests within a spring end receptacle encompassed within one jaw and the other spring end rests within a spring end receptacle encompassed within the other jaw, and the spring element is biased toward maintaining the jaws in an open position.

14. The guide of claim 12, wherein a roof bolter guide member has a recess formed therein for receiving a drill rod or bolt and said means for holding the rod guide within the mine roof bolter comprises a projection configured to be received in said recess.

15. The guide of claim 14, wherein said projection is replaceable to permit adapting said rod guide to operate with guide members of differing configurations.

16. The rod guide of claim 12, wherein the mine roof bolter includes operating mechanism for shifting said guide members toward each other under power and said jaw cavities are so configured that when forced toward each other toward a tightly closed position they may firmly and frictionally grip the coring rod therebetween, and the operating mechanism is actuatable to permit movement of said jaws away from said tightly closed position whereby the jaw cavities loosely enclose portions of the coring rod allowing guided rotation of the coring drill between said jaws.

17. A method of obtaining a core sample from a mine roof using a mine roof bolter having a pair of guide members mounted for shifting toward and away from each other to receive and guide a drill rod or bolt of a selected first diameter, comprising the steps of providing a coring rod guide adapter having a pair of opposed jaws having jaw cavities therein which together define a cylindrical coring cavity having a diameter substantially equal to a coring diameter which is greater than the first diameter, and supporting the rod guide adapter within the pair of guide members, inserting a coring rod into the coring rod guide such that the rod guide supports a portion of the coring rod, engaging the coring rod with means for impelling the coring rod into the mine roof, causing the roof bolting apparatus to impel the coring rod into the mine roof, and withdrawing the coring rod with a core sample contained therein from the mine roof thereby obtaining a core sample.

18. The method of claim 17, wherein the coring rod guide comprises a pair of jaws and means to yieldably bias the jaws toward an open position with respect to each other and which further comprises the step of forcing said jaws toward each other against the yieldable bias force to insert the coring rod guide between the guide members and thereafter releasing the jaws to allow them to open against inwardly facing surfaces of the guide members.

19. The method of claim 18, wherein each jaw is associated with a guide member, and said jaws and guide members are provided with complementary projections and recesses which upon inserting of the coring guide between the guide members and aligning the projections with the recesses, interact such that the projections extend into the recesses to hold the coring guide within the guide members.

20. The method of claim 17, wherein the jaws are mounted for shifting toward and away from each other under force, and are disposed in a first position to loosely enclose a coring rod to permit rod rotation for boring.

21. The method of claim 20, wherein the jaws are shifted to a second position against the core rod to firmly and frictionally grasp the core rod.

* * * * *

UNITED STATES PATENT AND TRADEMARK OFFICE

CERTIFICATE OF CORRECTION

PATENT NO. : 6,736,225 B2
DATED : May 18, 2004
INVENTOR(S) : Paul A. Pierce

It is certified that error appears in the above-identified patent and that said Letters Patent is hereby corrected as shown below:

Column 1,
Lines 3-4, "This application priority of appln 60/190,811 filed Mar. 21, 2000." should read -- This is the U.S. National Stage of International Application No. PCT/US01/08102, filed March 14, 2001, which was published in English under PCT Article 21(2), which in turn claims the benefit of U.S. Provisional Application No. 60/190,811, filed March 21, 2000. Both applications are incorporated herein in their entirety. --.

Column 7,
Line 43, "roof The" should read -- roof. The --.

Signed and Sealed this

Seventh Day of September, 2004

JON W. DUDAS
*Director of the United States Patent and Trademark Office*